US007594837B1

(12) United States Patent
Peterson

(10) Patent No.: US 7,594,837 B1
(45) Date of Patent: Sep. 29, 2009

(54) MANEUVERABLE AQUATIC TOWABLE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 12/246,565

(22) Filed: Oct. 7, 2008

(51) Int. Cl.
*B63B 35/00* (2006.01)

(52) U.S. Cl. ..... 441/66

(58) Field of Classification Search ..... 441/65–67, 441/79; D21/778, 803, 809
See application file for complete search history.

(56) References Cited

U.S. PATENT DOCUMENTS 5,702,278 A * 12/1997 Boucher ..... 709/243
6,247,984 B1 * 6/2001 Hatcher ..... 441/66
6,283,811 B1 * 9/2001 Peterson ..... 441/66
6,648,707 B1 * 11/2003 Peterson ..... 441/66

* cited by examiner

*Primary Examiner*—Ed Swinehart
(74) *Attorney, Agent, or Firm*—Sturm & Fox LLP

(57) ABSTRACT

The present invention provides an aquatic towable vehicle that can be maneuvered by the rider to steer the vehicle and to put the vehicle in a controlled spin while being towed behind a boat. The vehicle includes a passenger deck having a convex lower surface, a lowermost center point, and elevated ends. Fins are attached to the convex lower surface spaced out from the center point, and symmetrically disposed with respect to the longitudinal center line of the deck and the center point. The body portions of the fins are elevated above the center point so they are out of the water when the vehicle is level in the water. A tow strap is attached to the convex lower surface at the center point. When the rider's weight is shifted to move the vehicle from the level position, the fins on one side of the center point engage the water and allow the rider to steer. When the vehicle is in the level position and the fins are out of the water, the rider can put the vehicle in a controlled spin rotating around the center point.

18 Claims, 9 Drawing Sheets

MANEUVERABLE AQUATIC TOWABLE VEHICLE

BACKGROUND OF THE INVENTION

1. Field of the Invention

The present invention relates to the field of aquatic recreational towables, and more particularly to a towable where the passenger can maneuver the vehicle to steer the vehicle and to put the vehicle into a controlled spin.

2. Description of Related Art

Aquatic towable vehicles have long been popular with water sport enthusiasts. As one gains experience and skills in using the towable vehicles, a desire for a more challenging and exciting ride becomes evident. Skilled riders also want an ability to control the towable so they can use their skills to maneuver the towable to produce a ride that is thrilling to both the rider and to any observers.

As a consequence of the foregoing situation, there has existed a longstanding need for a new and improved maneuverable aquatic towable vehicle, and the provision of such a construction is a stated object of the present invention.

BRIEF SUMMARY OF THE INVENTION

Briefly stated, the present invention provides an aquatic towable vehicle that can be maneuvered by the rider to steer the vehicle and to put the vehicle in a controlled spin while being towed behind a boat. The vehicle includes a passenger deck having a convex lower surface, a lowermost center point, and elevated ends. Fins are attached to the convex lower surface spaced out from the center point, and symmetrically disposed with respect to the longitudinal center line of the deck and the center point. The body portions of the fins are elevated above the center point so they are out of the water when the vehicle is level in the water. A tow strap is attached to the convex lower surface at the center point. When the rider's weight is shifted to move the vehicle from the level position, the fins on one side of the center point engage the water and allow the rider to steer. When the vehicle is in the level position and the fins are out of the water, the rider can put the vehicle in a controlled spin rotating around the center point.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
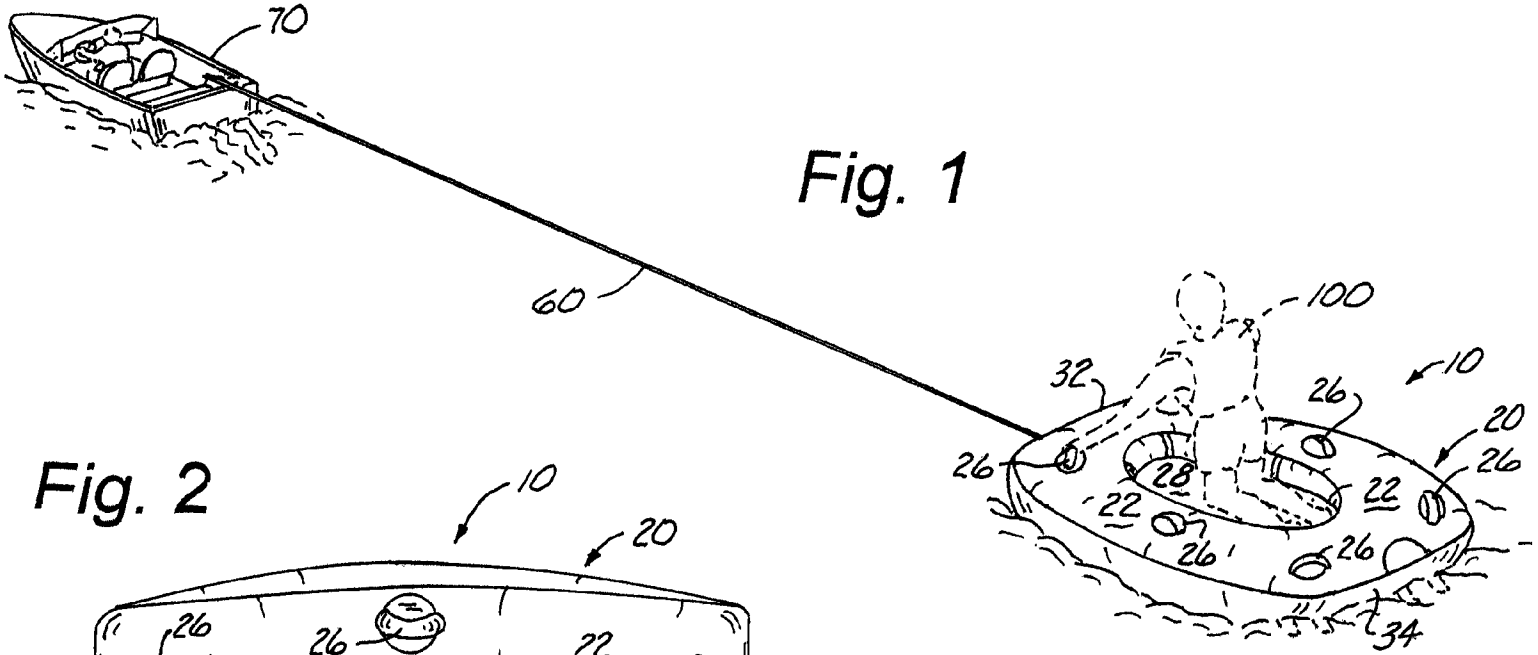
FIG. 1 is a perspective view of the maneuverable aquatic vehicle of the present invention towed behind a boat.
Figure 2:
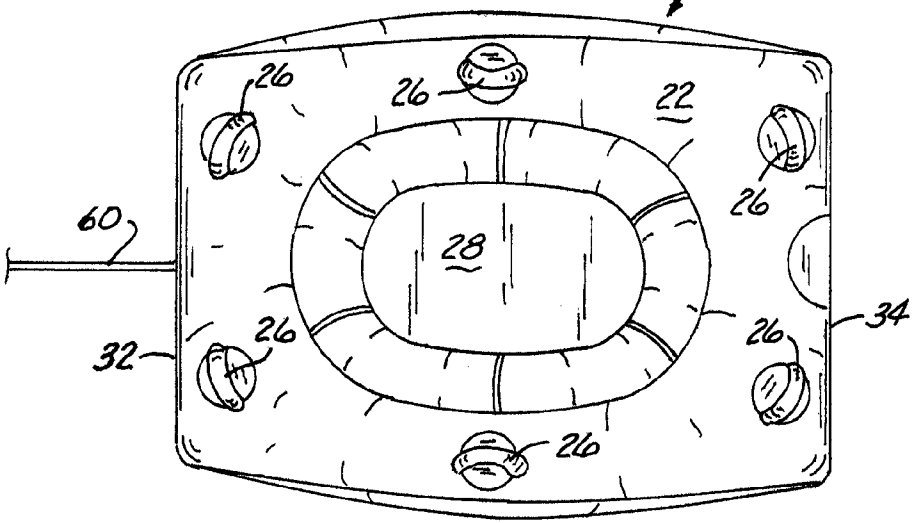
FIG. 2 is an enlarged top plan view of the vehicle.
Figure 3:
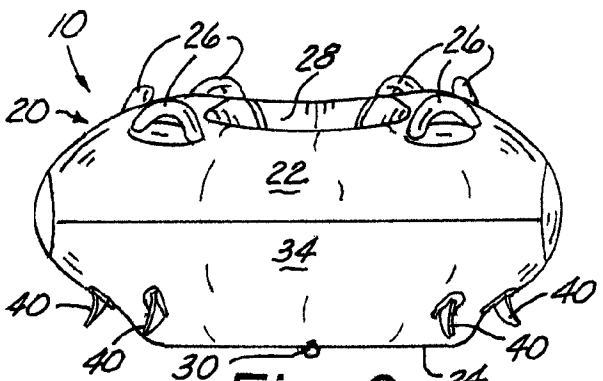
FIG. 3 is an end elevational view thereof.

As can be seen by reference to the drawings, and in particular to FIG. 1, the maneuverable aquatic towable vehicle that forms the basis of the present invention is designated generally by the reference to number 10. The vehicle 10 includes a passenger deck 20 having an upper surface 22 and a convex lower surface 24. Handles 26 are attached to the upper surface 22 and are spaced at regular intervals around a peripheral rim that defines a recessed cockpit 28.

Figure 4:
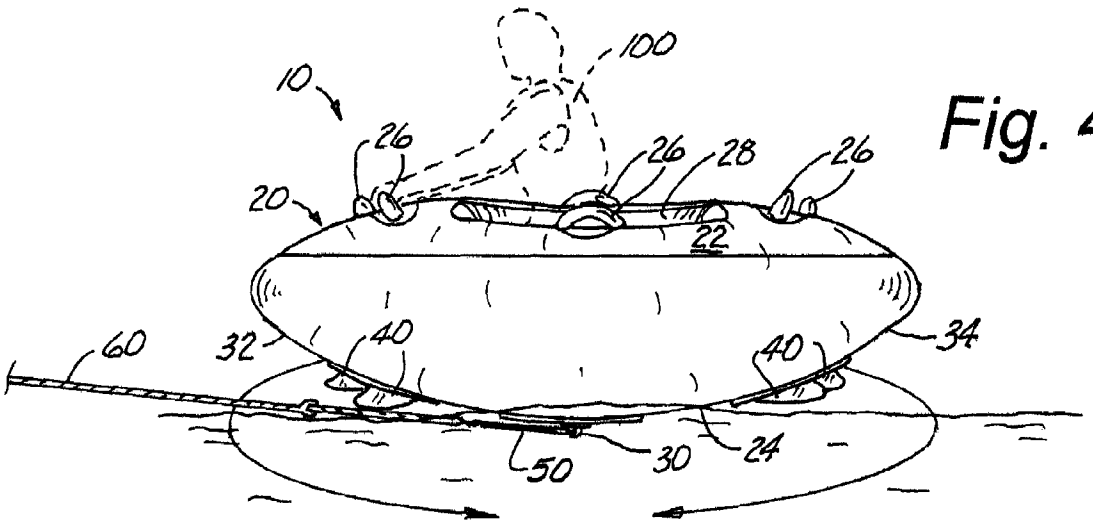
FIG. 4 is a side elevational view thereof, where the vehicle is level in the water with the fins out of the water to allow the vehicle to be put into a controlled spin.
Figure 5:
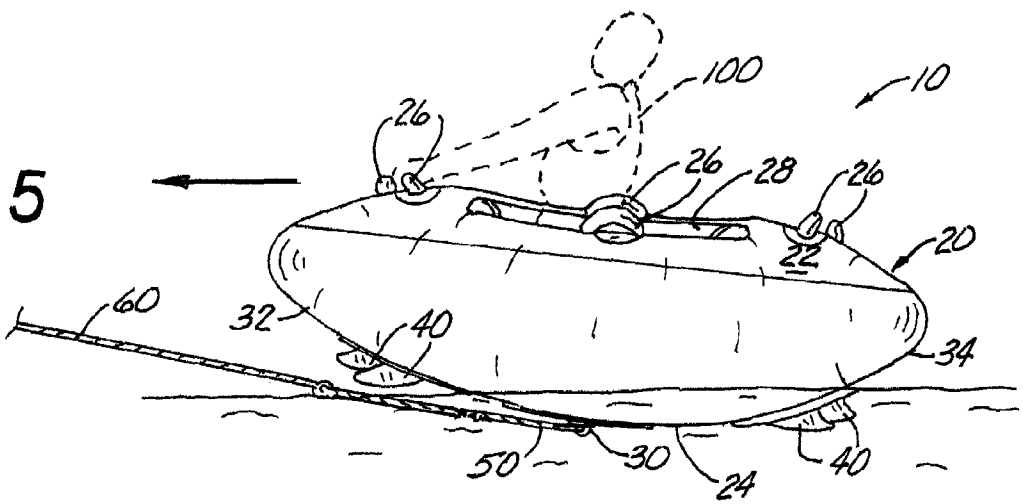
FIG. 5 is a side elevational view thereof where the vehicle is tilted back in the water with the fins engaging the water to allow the vehicle to be steered.
Figure 6:
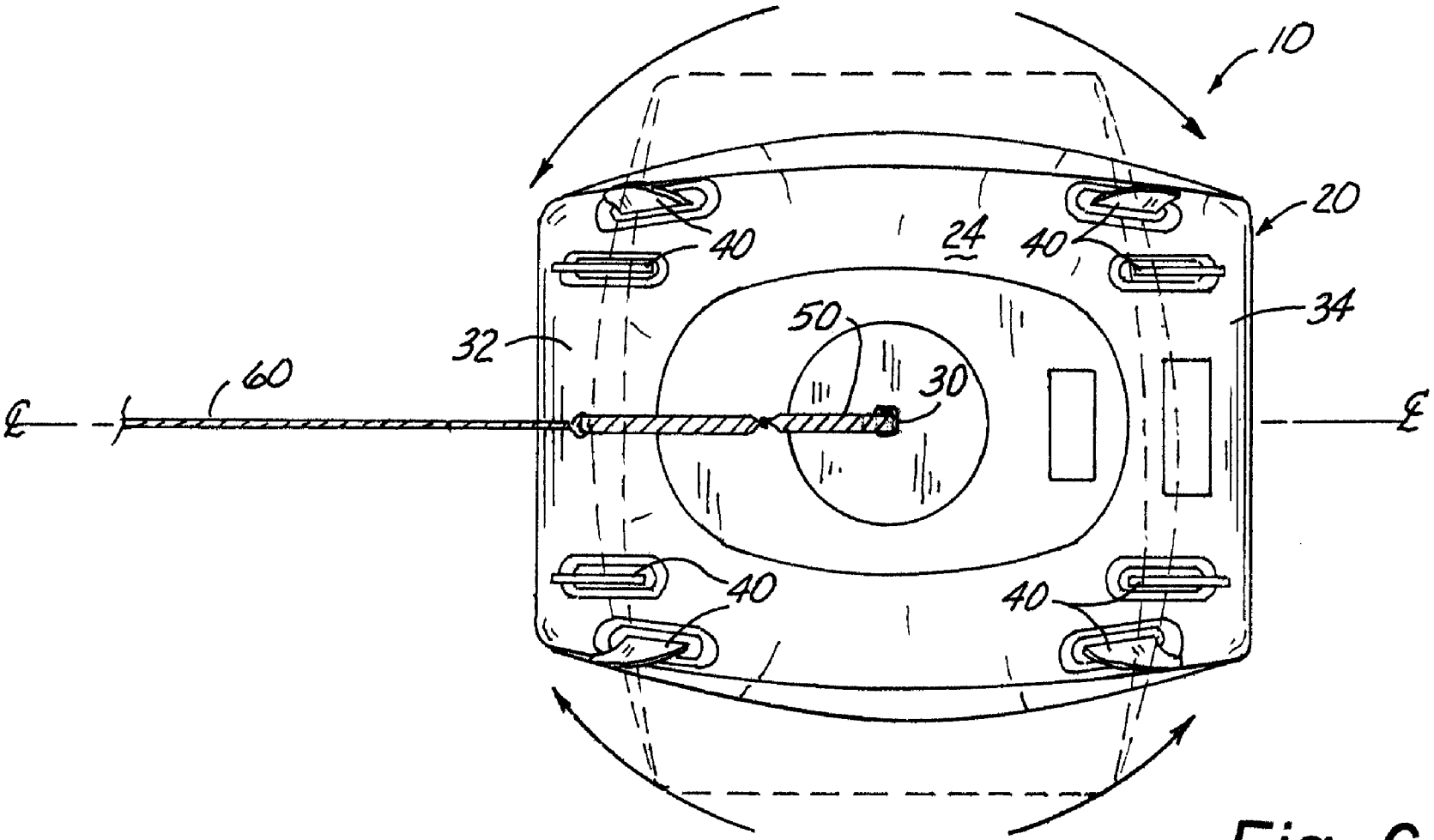
FIG. 6 is a bottom plan view, illustrating the vehicle in a position to spin about the center point where the tow strap is attached.
Figure 7:
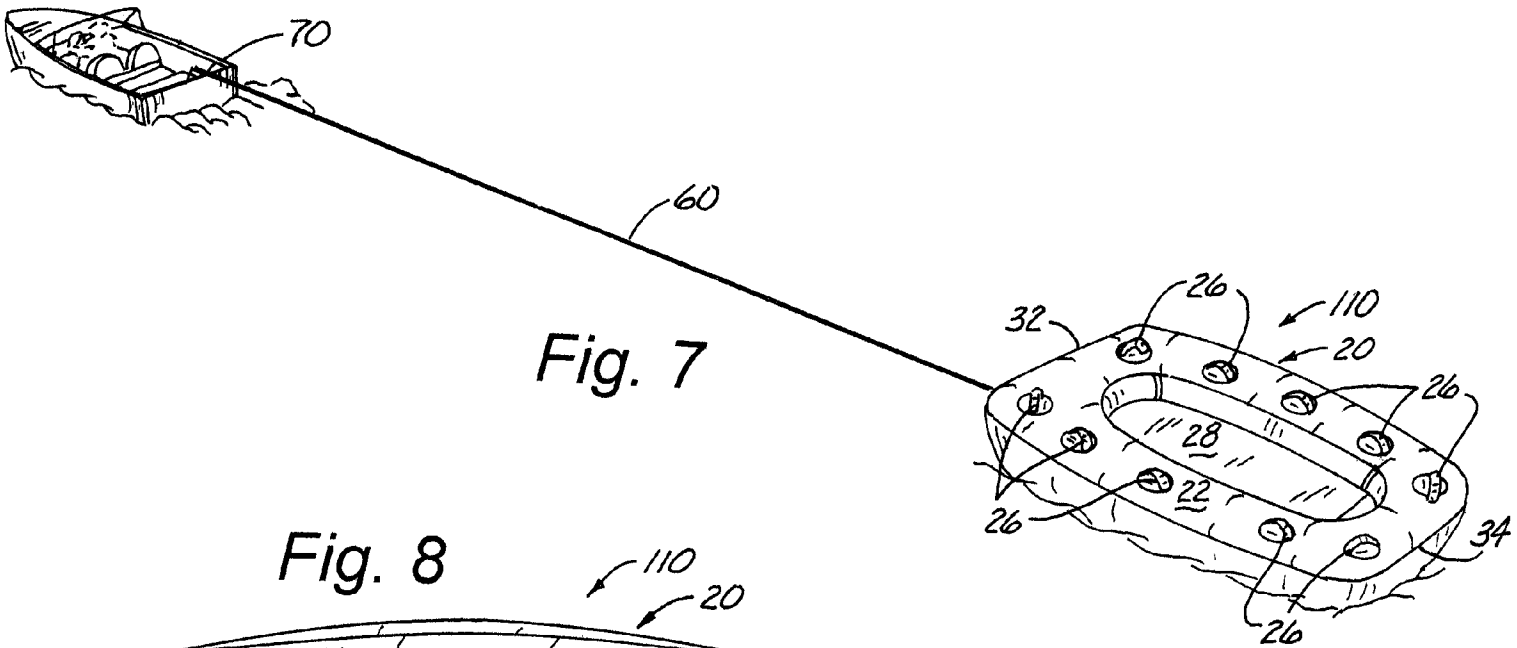
FIG. 7 is a perspective view of an alternate embodiment of the invention, where the vehicle is sized to accommodate two riders.
Figure 8:
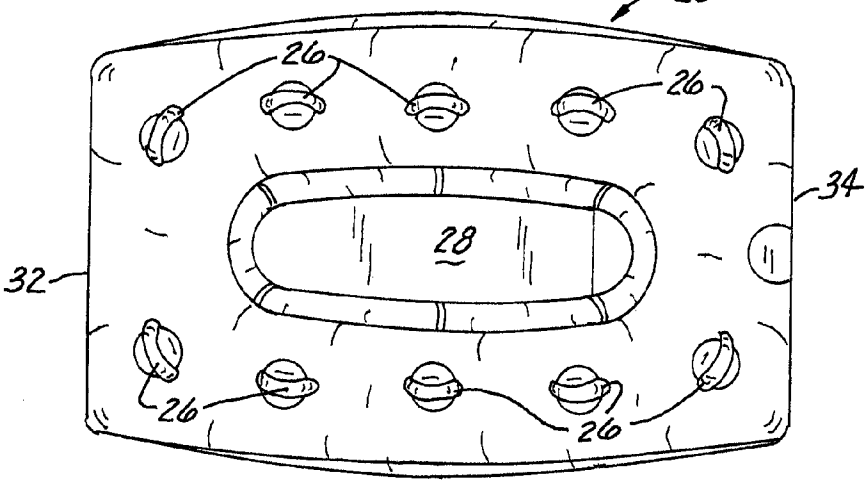
FIG. 8 is an enlarged top plan view thereof.
Figure 9:
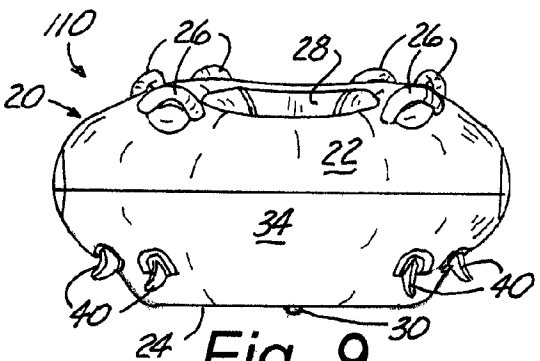
FIG. 9 is an end elevational view thereof.
Figure 10:
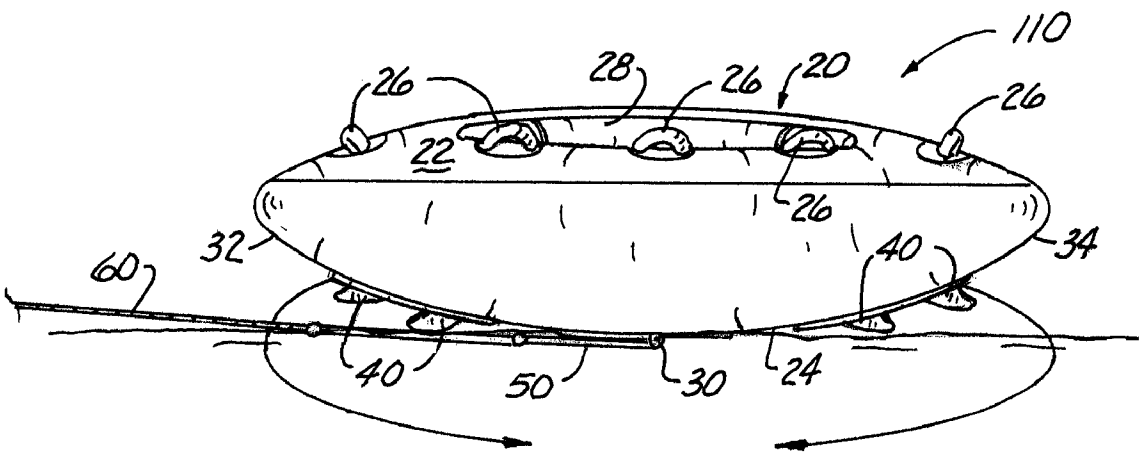
FIG. 10 is a side elevational view thereof, showing the vehicle level in the water to allow it to spin.
Figure 11:
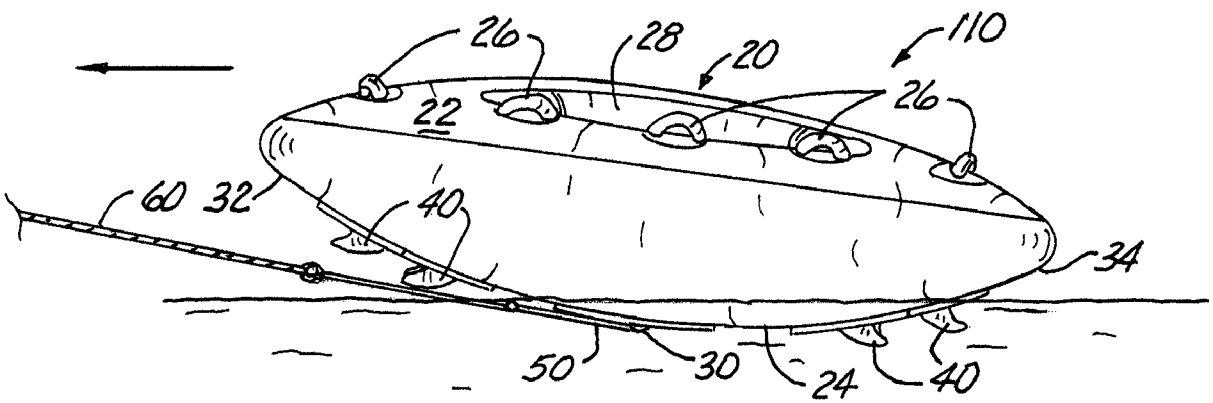
FIG. 11 is a side elevational view thereof, showing the vehicle tilted back in the water to allow it to be steered.
Figure 12:
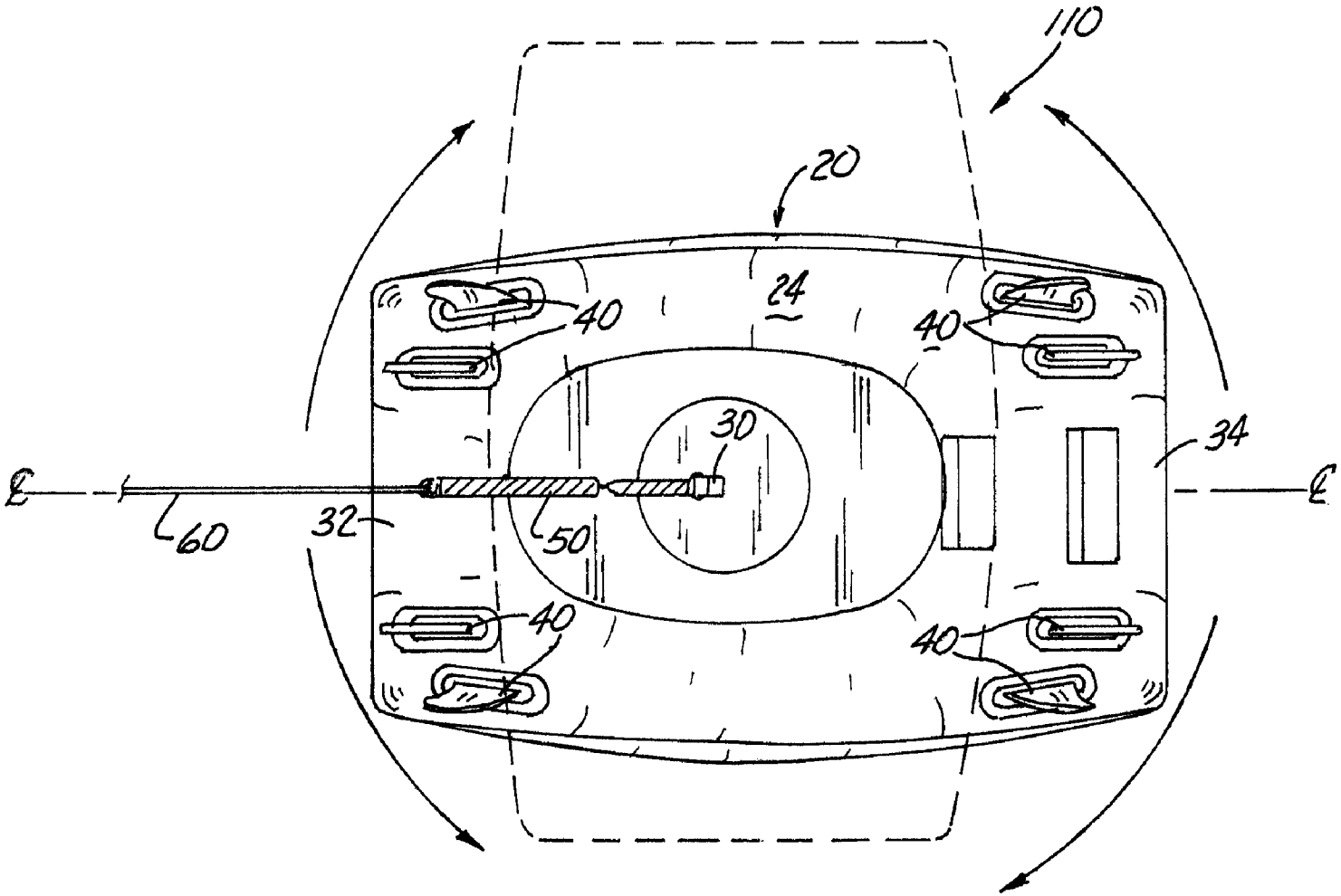
FIG. 12 is a bottom plan view thereof, illustrating the vehicle spinning about the center point.
Figure 13:
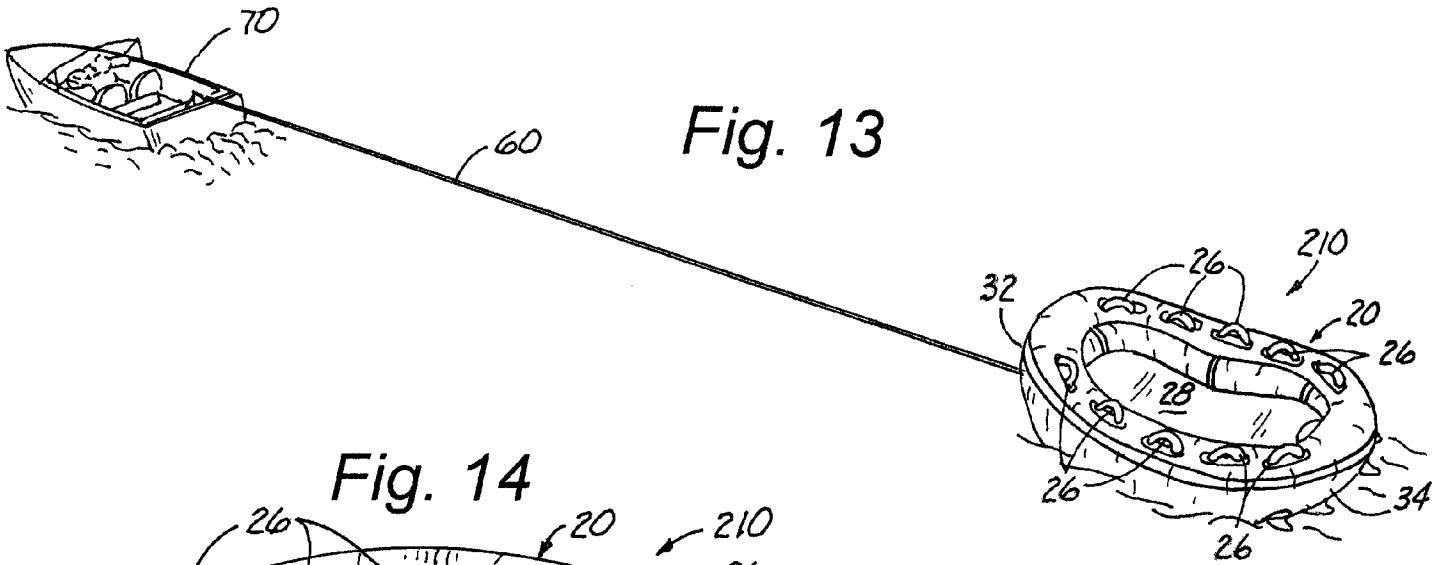
FIG. 13 is a perspective view of another alternate embodiment of the invention, illustrating a two rider vehicle where the deck has a convex upper surface.
Figure 14:
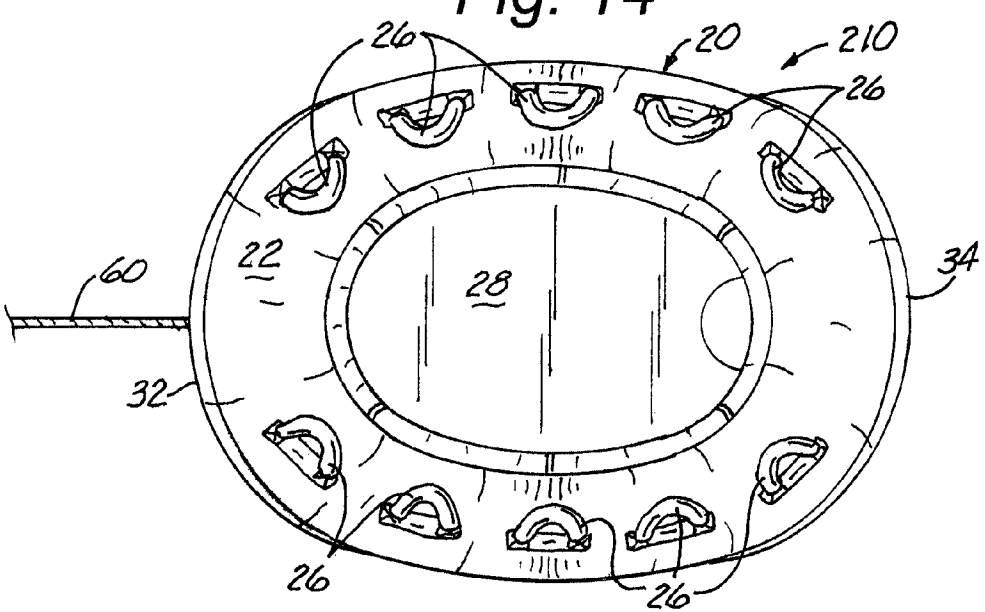
FIG. 14 is an enlarged top plan view thereof.
Figure 15:
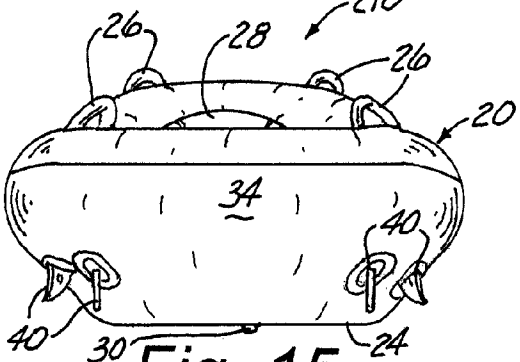
FIG. 15 is an end elevational view thereof.
Figure 16:
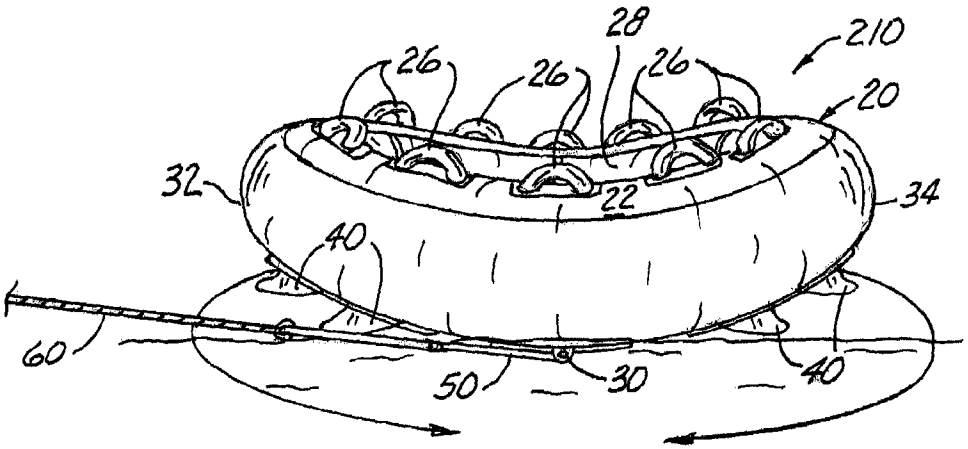
FIG. 16 is a side elevational view, showing the vehicle level in the water to allow it to spin.
Figure 17:
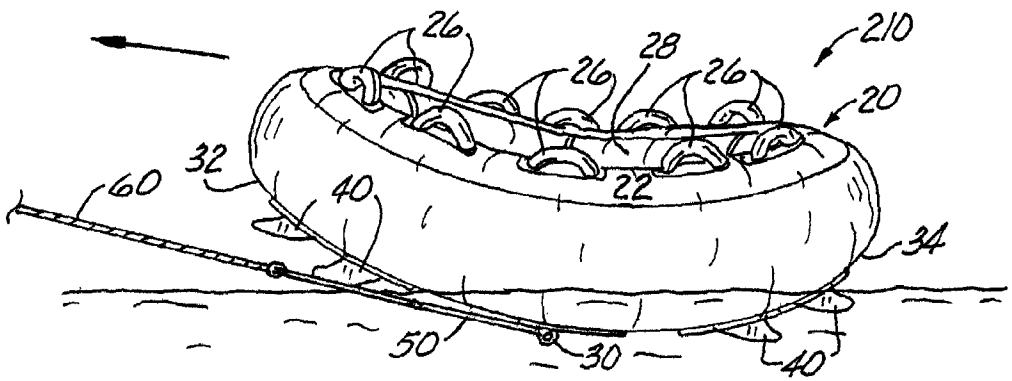
FIG. 17 is a side elevational view, showing the vehicle tilted back in the water to allow it to be steered.
Figure 18:
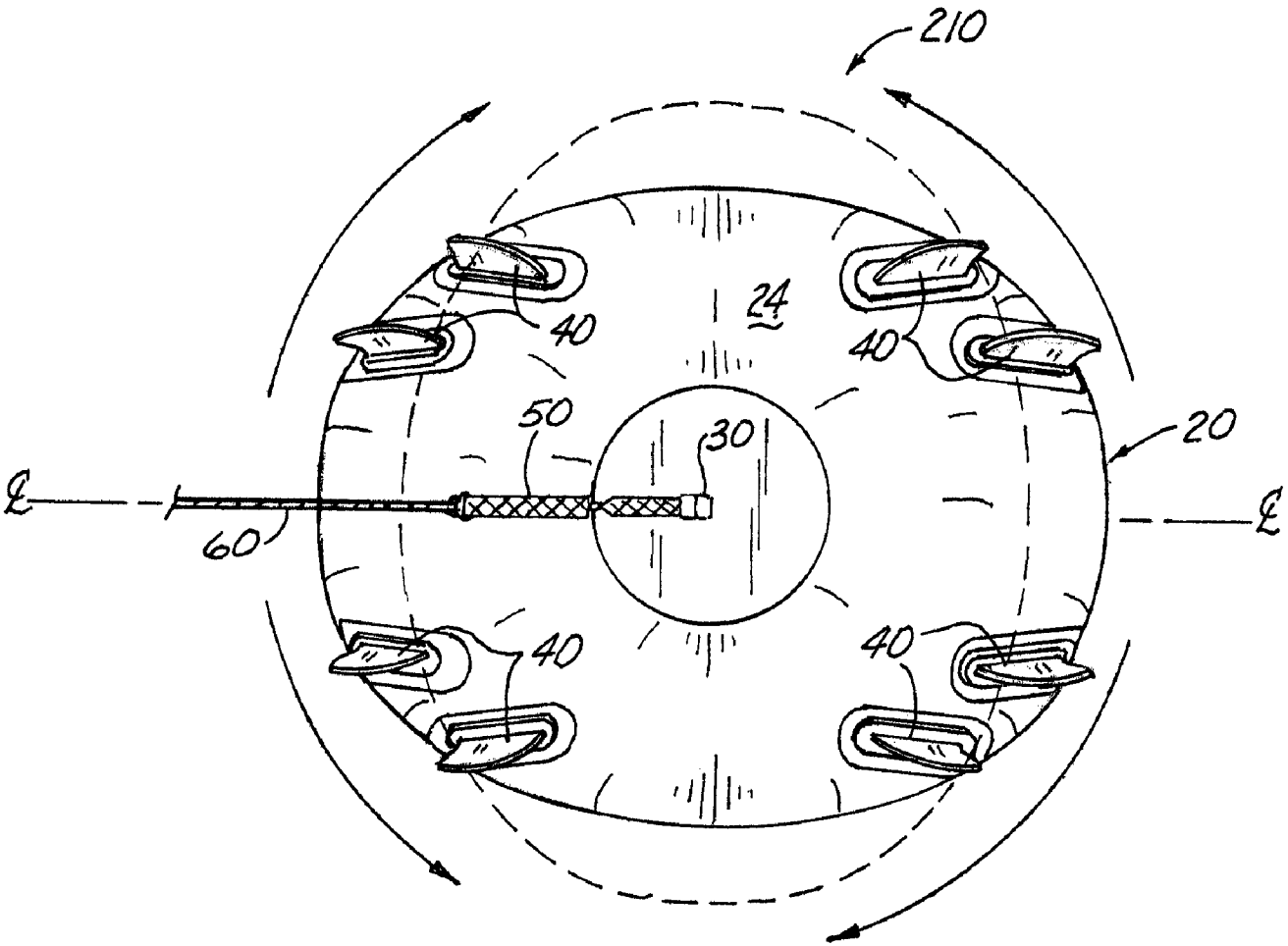
FIG. 18 is a bottom plan view thereof, illustrating the vehicle spinning about the center point.

As best shown in FIGS. 4-6, the convex lower surface 24 has a lowermost center point 30, and elevated ends 32 and 34. A number of downwardly depending fins 40 are attached to the lower surface 24 between the center point 30 and the elevated ends 32 and 34. The entire body of each of the fins 40 is elevated above the center point 30 when the vehicle 10 is in a level position (FIG. 4). Also, the fins 40 are symmetrically disposed on the lower surface 24 with respect to the center point 30 and the longitudinal centerline of the deck 20 (FIG. 6.) A tow strap 50 is attached to the lower surface 24 at the center point 30, and a tow line 60 interconnects the vehicle 10 to a towing boat 70.

In use, the rider 100 is in the cockpit 28, usually in a kneeling or sitting position, and grasps the handles 26 on opposite sides of the deck 20. To steer the vehicle 10, the rider 100 shifts their weight so that the deck 20 is tilted back and the fins 40 are below water level, as shown in FIG. 5. To cause the vehicle 10 to spin, the rider 100 shifts their weight so that the deck 20 sits substantially level in the water and all the fins 40 are out of the water, as shown in FIG. 4. In this position, the rider can maneuver the vehicle so that is spins around the center point 30.

The embodiment of the invention illustrated in FIGS. 1-6 is a vehicle 10 for a single rider, whereas the alternate embodiment, illustrated in FIGS. 7-12 is a vehicle 110 designed to accommodate two riders. The additional alternate embodiment, illustrated in FIGS. 13-18 is also a two-rider vehicle 210, but having a convex upper surface that generally corresponds to the shape of the lower surface 24. In the two-rider embodiments, the riders work together to maneuver the vehicle to be in the desired steering or spinning mode.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An aquatic recreational towable, comprising:

a passenger deck including an upper surface and a convex lower surface, the lower surface having elevated first and second ends elevated first and second sides, a longitudinal centerline equidistant between the elevated first and second sides, a transverse centerline equidistant between the elevated first and second ends, and a lowermost center point located at the intersection of the longitudinal centerline and the transverse centerline;

a first fin having a body portion, the first fin being attached to the convex lower surface between the center point and the first end, the entire body portion of the first fin being disposed at an elevation above the center point;

a second fin having a body portion, the second fin being attached to the convex lower surface between the center point and the second end, the entire body portion of the second fin being disposed at an elevation above the center point; and a tow strap attached to the lower surface at the center point.

2. The aquatic recreational towable of claim 1, wherein the passenger deck is an inflatable member.

3. The aquatic recreational towable of claim 1, wherein the first and second fins are spaced at an equal distance from the center point.

4. The aquatic recreational towable of claim 2, wherein the first and second fins are spaced at an equal distance from the center point.

5. The aquatic recreational towable of claim 1, further including a plurality of first and second fins attached to the convex lower surface, and being symmetrically disposed with respect to the longitudinal centerline and the center point.

6. The aquatic recreational towable of claim 2, further including a plurality of first and second fins attached to the convex lower surface, and being symmetrically disposed with respect to the longitudinal centerline and the center point.

7. The aquatic recreational towable of claim 1, wherein the passenger deck includes a convex upper surface.

8. The aquatic recreational towable of claim 1, wherein the passenger deck includes a flat upper surface.

9. The aquatic recreational towable of claim 1, wherein the passenger deck includes an elevated peripheral rim, and a recessed cockpit area enclosed by the peripheral rim.

10. The aquatic recreational towable of claim 2, wherein the passenger deck includes an elevated peripheral rim, and a recessed cockpit area enclosed by the peripheral rim.

11. The aquatic recreational towable of claim 1, wherein a plurality of handles are attached to the upper surface of the passenger deck.

12. The aquatic recreational towable of claim 2, wherein a plurality of handles are attached to the upper surface of the passenger deck.

13. The aquatic recreational towable of claim 3, wherein a plurality of handles are attached to the upper surface of the passenger deck.

14. The aquatic recreational towable of claim 5, wherein a plurality of handles are attached to the upper surface of the passenger deck.

15. The aquatic recreational towable of claim 7, wherein a plurality of handles are attached to the upper surface of the passenger deck.

16. The aquatic recreational towable of claim 8, wherein a plurality of handles are attached to the upper surface of the passenger deck.

17. The aquatic recreational towable of claim 9, wherein a plurality of handles are attached to the upper surface of the passenger deck.

18. The aquatic recreational towable of claim 17, wherein the plurality of handles are spaced around the peripheral rim of the passenger deck.

* * * * *